US005133614A

United States Patent [19]

Buschmann et al.

[11] Patent Number: 5,133,614

[45] Date of Patent: Jul. 28, 1992

[54] DEVICE FOR DRIVING A PRINTER PRINT-HEAD CARRIAGE HAVING A BELT TENSIONING DEVICE AND A RIBBON DRIVE CLUTCH

[75] Inventors: Ulrich Buschmann, Elchingen; Günter Gomoll, Nersingen/Leibi; Wolfgang Hauslaib, Langenau, all of Fed. Rep. of Germany

[73] Assignee: Mannesmann Aktiengesellschaft, Dusseldorf, Fed. Rep. of Germany

[21] Appl. No.: 505,844

[22] Filed: Apr. 6, 1990

[30] Foreign Application Priority Data

Apr. 7, 1989 [DE] Fed. Rep. of Germany ..... 3911887

[51] Int. Cl.[5] ..... B41J 19/18

[52] U.S. Cl. ..... 400/320; 400/233; 400/231; 400/222

[58] Field of Search ..... 400/233, 231, 229, 235, 400/319, 320, 221, 222, 236, 322

[56] References Cited

U.S. PATENT DOCUMENTS

| | | | |
|---|---|---|---|
| 3,854,670 | 12/1974 | Bertolazzi | 400/221 |
| 4,300,847 | 11/1981 | Hoffman | 400/233 |
| 4,342,520 | 8/1982 | Isobe et al. | 400/231 |
| 4,395,151 | 7/1983 | Krenz | 400/320 |
| 4,484,485 | 11/1984 | Matsuhisa | 400/322 |
| 4,526,486 | 7/1985 | Kikuchi et al. | 400/229 |
| 4,531,849 | 7/1985 | Dobashi | 400/229 |
| 4,596,480 | 6/1986 | Takada | 400/229 |
| 4,658,270 | 4/1987 | Katsura et al. | 400/236 |
| 4,678,354 | 7/1987 | Olsen | 400/335 |
| 4,760,405 | 7/1988 | Nagira et al. | 400/233 |
| 4,770,553 | 9/1988 | Deschamps et al. | 400/234 |
| 4,850,725 | 7/1989 | Walker et al. | 400/233 |
| 4,908,632 | 3/1990 | Ishikawa | 400/229 |
| 4,991,984 | 2/1991 | Fare | 400/335 |

FOREIGN PATENT DOCUMENTS

| | | | |
|---|---|---|---|
| 0110487 | 7/1982 | Japan | 400/233 |
| 0201890 | 11/1984 | Japan | 400/233 |
| 0795880 | 8/1986 | Japan | 400/236 |
| 0257877 | 11/1987 | Japan | 400/233 |

*Primary Examiner*—Edgar S. Burr
*Assistant Examiner*—John S. Hilten
*Attorney, Agent, or Firm*—Cohen, Pontani, Lieberman & Pavane

[57] ABSTRACT

In a printer, a drive motor, a drive roller arranged on the shaft of the motor, a reversal roller in spaced relation to the drive roller, and an elongated drive belt trained about the drive and reversal rollers form a tensioning device, the belt being fastened at its ends to a print-head carriage for selectively displacing the carriage in the forward and reverse directions along and relative to a printable substrate support roller or base. The reversal roller is carried in a carrier housing which movably and cooperatively engages a spring-loaded tensioning wedge for maintaining the elongated drive belt in a predetermined tensioned or stretched relation. In order to avoid the need for a separate or specialized drive motor and an additional drive belt for advancing an inked printing ribbon, the drive force for the inked-ribbon drive shaft is derived from the reversal roller which, in the normal operation of the printer, is rotatable in opposite directions for selectively positioning the print-head carriage along the printable substrate support. For this purpose, a clutch member is interposed between the reversal roller and a gearwheel associated with the inked-ribbon drive shaft, the clutch member being longitudinally movable into coupled and uncoupled relations with the inked-ribbon gearwheel as a function of the direction of rotation of the reversal roller.

21 Claims, 3 Drawing Sheets

DEVICE FOR DRIVING A PRINTER PRINT-HEAD CARRIAGE HAVING A BELT TENSIONING DEVICE AND A RIBBON DRIVE CLUTCH

FIELD OF THE INVENTION

The present invention relates to a device for driving a print-head carriage for a printer, most particularly a dot-matrix printer.

BACKGROUND OF THE INVENTION

In printers—such as dot-matrix printers—of the type including a movable printer-head carriage, it is necessary to provide a driving arrangement for selectively moving the print-head carriage in the forward and reverse directions along and relative to a printable substrate-supporting roller or other base. For this purpose, arrangements incorporating a drive motor, opposed driving and reversal pulleys, and a belt or rope or other pulling means trained about the opposed rollers and connected to the print-head carriage are well known. Bidirectional operation of the drive motor rotates the pulleys in the forward and reverse directions whereby the encircling belt is longitudinally displaced and carries the carriage to selected positions along the printable-substrate support. It is also known in such arrangements to mount the reversal pulley to a carrier housing which rests against a spring-loaded tensioning wedge for suitably stretching or otherwise tensioning the belt.

Also common in such arrangements is the provision of a slit disc which rotates in synchronism with the bidirectional rotation of the shaft of the drive motor or with one of the drive and reversal pulleys. The slit disc is scanned by a beam of light so as to generate print-head carriage path-dependent pulses which are utilized for dynamically sensing or computing the then-current position of the carriage. Other, alternative arrangements for continuously determining the present position of the moving print-head carriage are also known such, for example, as the use of a stepping-motor drive for the belt-encircling pulleys.

Such tensioning arrangements for a belt-like pulling means or displacement transmission member of a print-head carriage drive device in typewriters or similar office machines are disclosed, by way of example, in Federal Republic of Germany Laid Open Patent Application No. OS 33 19 671. For purposes of this description it is assumed that a substantially precise adjustment of the position of the print-head carriage is rendered possible by such arrangements upon both forward and reverse travel or displacement of the print-head carriage.

It is also common in printers of this type to provide or include additional elements that also require driven movement or displacement in the operation of the printer or typewriter or other office machine. Thus, for example, such apparatus typically include an inked ribbon in conjunction with which printed characters or symbols are generated and transferred to the printable substrate by the print-head. Apparatus heretofore known in the art carries out the movement or displacement of such additional parts or elements through the provision of separate drive motors and pulling means and the like. This results in substantial duplications of components in the printing apparatus, increasing manufacturing costs and decreasing the operational efficiency and, in some cases, the reliability of the apparatus.

SUMMARY OF THE INVENTION

It is accordingly the desideratum of the present invention to provide an arrangement of elements which utilize the tensioning and drive means for the carriage-moving drive belt in a printer for operating other displaceable assemblies or components that form a part of the printer and thereby reduce or eliminate the need for unnecessarily duplicated components.

This and other objects are achieved in accordance with the invention as hereinafter, by way of example, disclosed. In a currently preferred embodiment, the reversal pulley or roller is rotatable by way of the drive belt in either of two opposite rotative directions as the print-head carriage is selectively displaced along the printing path. In accordance with the invention, a drive force for an associated inked-ribbon drive shaft is derived from the reversal roller through a clutch that is operatively engageable and disengageable as a function of the rotative direction of the reversal roller. The combination of the print-head carriage tensioning device with the derived inked-ribbon drive render unnecessary the separate and duplicative provision of a drive motor and additional drive belt for moving the inked ribbon. Moreover, by deriving the inked-ribbon drive from the carrier housing through the aforementioned engageable and disengageable clutch-type coupling, the inked ribbon is moved or pulled along, as is intended, in a single direction of movement. This arrangement is particularly straightforward and advantageously simple from the standpoints of both manufacture and assembly. A particularly advantageous feature of this arrangement is that the inked ribbon is advanced in steps related, in a substantially constant ratio, to the path length of movement of the print-head carriage.

As herein disclosed in accordance with the preferred embodiment of the invention, the carrier housing is formed of connected lower and upper housing parts and defines rotary bearings for the reversal roller and for an inked-ribbon drive shaft. The reversal roller carries a coaxial first gearwheel, and a second gearwheel is rotatably mounted, in spaced relation to the reversal roller, on the inked-ribbon drive shaft and within the carrier housing. An intermediate gearwheel under spring pressure and displaceable forward and backward along a longitudinal or arcuate guide is mounted for rotation between the coaxial first gearwheel of the reversal roller and the second gearwheel of the inked-ribbon drive shaft. This intermediate gearwheel defines the clutch coupling element.

The use of a spring force on the intermediate gearwheel enables the coupling and uncoupling to take place under a substantially constant force. This arrangement is furthermore particularly advantageous in that the carrier housing forms a separable structural unit which may be assembled in its entirety remote from the printer and thereafter mounted thereto.

The substantially constant clutch coupling force may be provided by a one-armed spring fastened to the lower housing part and pressing or resting with an initial tension against the circumference or periphery of the longitudinally displaceable intermediate gearwheel. The force relationships accordingly remain substantially constant with the invariable length of the lever arm of the spring.

As a particular improvement to this arrangement, the one-armed spring may be formed by injection molding of the same on the lower housing part which may, for example, be fabricated of a plasticizable plastic material. This obviates the need for a separate or otherwise specialized securement of the spring to the housing.

In accordance with another feature of the invention, the upper and lower housing parts are provided with spacers and the housing parts are interconnectable through engagement of spring clamp arms defined on one or more sides of the housing. Thus, following insertion of the reversal roller, the gearwheel and drive shaft for the inked-ribbon drive, and the intermediate gearwheel, these components are axially fixed in position through coupling interengagement of the upper and lower housing parts and accordingly require no separate or additional assembly operations or component parts.

Another feature of the invention is that the carrier housing movably engages the tensioning wedge by way of a projection that protrudes from the housing and rests atop a ledge-like shoulder on the wedge, the shoulder extending substantially perpendicular to the direction of tensioning movement of the housing. The tensioning wedge carries a first abutment against which the first, longer arm of a leg spring presses, and a second, shorter leg of the leg spring abuts a second abutment defined on the printer frame. By this arrangement, which movably positions the carrier housing relative to the tensioning wedge, it is possible to provide a desirably short range of tensioning adjustability of the drive belt trained about the driving and reversal rollers.

The reversal roller is further provided, on its surface that receives the drive belt, with a tooth-like bead which extends substantially parallel to its axis and which is preferably repeated at least every quarter of the reversal roller circumference. This construction enables the integral or unitary fabrication of the reversal roller and coaxial gearwheel, including flange disks, thereby rendering unnecessary the heretofore-required use of separate flange disks.

The operative dependability of the carrier housing structure is further increased by rotatably mounting the reversal roller for rotation about an anti-friction bearing that is embedded in a vibration-damping elastic bearing shell inserted concentrically into the reversal roller.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
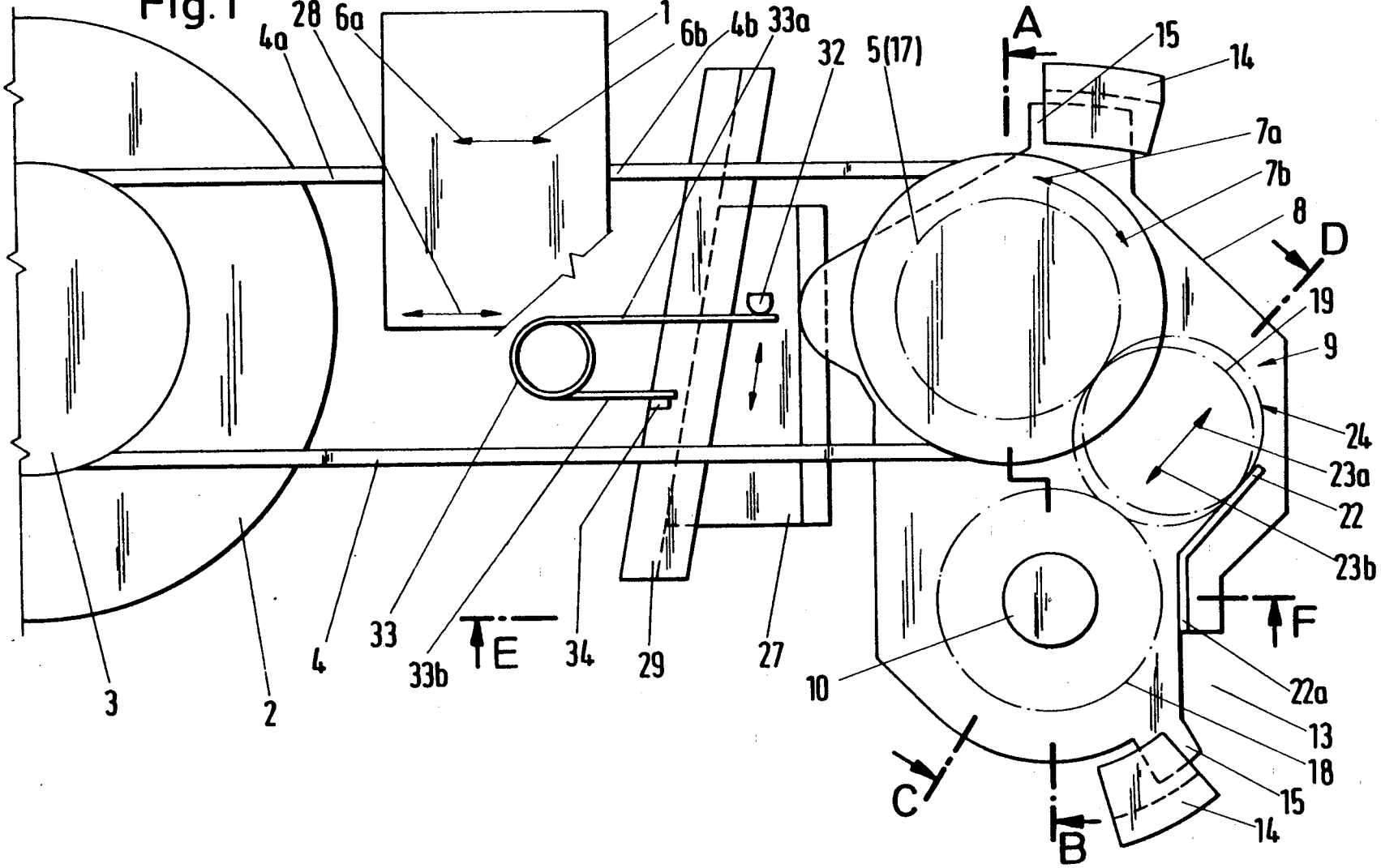
FIG. 1 is a top plan view of the inventive arrangement of a motor, drive roller, reversal roller, print-head carriage and carrier housing in a printing apparatus constructed in accordance with a preferred embodiment of the present invention.

The present invention relates generally to arrangements for the driven selective movement of a print-head carriage, designated by the reference numeral 1 and used by way of example in dot-matrix, thermal transfer, type-wheel and other printers and the like which incorporate, a print-head carriage for carrying a print-head and which are displaceable in the forward and reverse directions by a pulling means or other transmission member. With particular reference to FIG. 1, a drive motor 2 carries on its shaft a drive pulley or roller 3. An elongated belt-like pulling means 4 is trained in partly encircling relation about the drive roller 3 and about an opposed reversal pulley or roller 5 located in spaced relation to the drive roller 3. The ends 4*a*, 4*b* of the pulling means 4 are fastened to the print-head carriage 1 so that motor-driven forward and reverse longitudinal movements of the pulling means selectively displaces the print-head carriage 1 along and relative to a printable substrate supporting roller or the like (not shown). The pulling means 4 may comprise, by way of example, an elongated pull rope, flat belt or toothed belt and, solely for convenience, is hereinafter referred to as the belt 4.

The reversal roller 5 turns in its opposed directions of rotation 7*a*, 7*b* in accordance with the forward and reverse movements of the print-head carriage 1 in the directions 6*a*, 6*b*, respectively. For this purpose, the reversal roller 5 is mounted for rotation in a carrier housing 8. As will hereinafter become apparent, the reversal roller 5 transmits a driving force to an inked-ribbon drive shaft 10 in only one of its directions of rotation 7*a*, 7*b*. This unidirectional transmission of driving force is effected through an operable clutch 9. A conventional inked-ribbon cassette (not shown) receives the end of the inked-ribbon drive shaft 10 in a hollowed wheel located within the cassette (and about which the inked-ribbon is typically wound) when the inked-ribbon cassette is inserted into the printer.

The carrier housing 8 is formed of a lower part 11 and an upper part 12 which are secured together to define an interior space. Clamps 14 under which projections 15 of the lower housing part 11 are receivable are provide don a frame 13 of the printer.

The carrier housing 8 includes interior rotary bearings 16 defined on both the lower and upper housing parts 11, 12. The inked-ribbon drive shaft 10 is rotatably mounted in a rotary bearing 16 of the lower housing part 11, and the reversal roller 5 is rotatably mounted in a rotary bearing 16 of the upper housing part 12. A coaxial first gearwheel 17 is integrally or otherwise formed on the reversal roller 5.

Figure 3:
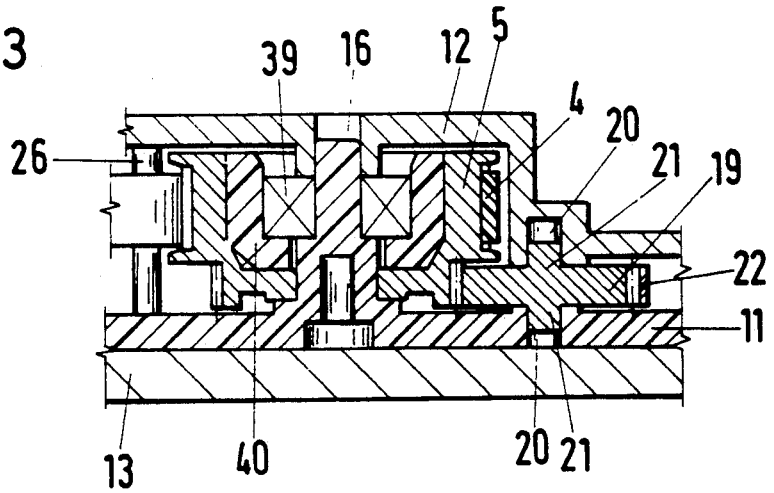
FIG. 3 is a vertical cross-section taken along the lines C–D in FIG. 1.

A second gearwheel 18 is mounted for axial rotation in the carrier housing 8 and, in the presently-disclosed embodiment, may be formed as an integral part of or otherwise secured to and carried on the inked-ribbon drive shaft 10. An intermediate gearwheel 19 is mounted for rotation between reversal roller 5 and its coaxial first gearwheel 17, on the one hand, and the inked-ribbon drive shaft and second gearwheel 18, on the other. The intermediate gearwheel 19 is further mounted for back-andforth displacement along a longitudinal guide 20, which guide may define a straight or predeterminately curved or arcuate path, via bearing journals 21 and against the force of a one-armed spring 22, to form a clutch 9. The directions of back-and-forth displaceability of the intermediate gearwheel 19 are indicated by the arrowheads 23*a*, 23*b* in FIG. 1. The longitudinal guide 20 for the bearing journals 21 is defined in opposed relation in the lower and upper housing parts 11, 12 (FIG. 3).

In a particularly preferred form of the invention, the one-armed spring 22 is integrally formed as a part of the lower housing part 11; to this end, the spring 22 may be injection molded with an extension 22*a* of the lower housing part 11, the entirety being formed of a resiliently flexible plastic material. The spring 22 abuts, with an initial force or tension, against the circumference 24 of the longitudinally-displaceable intermediate gearwheel 19.

Figure 2:
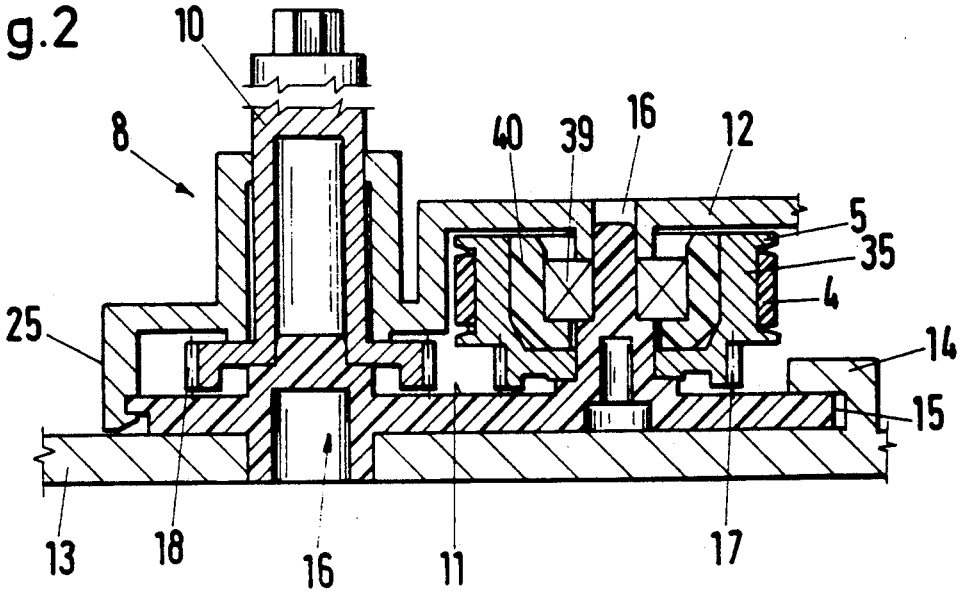
FIG. 2 is a vertical cross-section taken along the lines A–B in FIG. 1.
Figure 4:
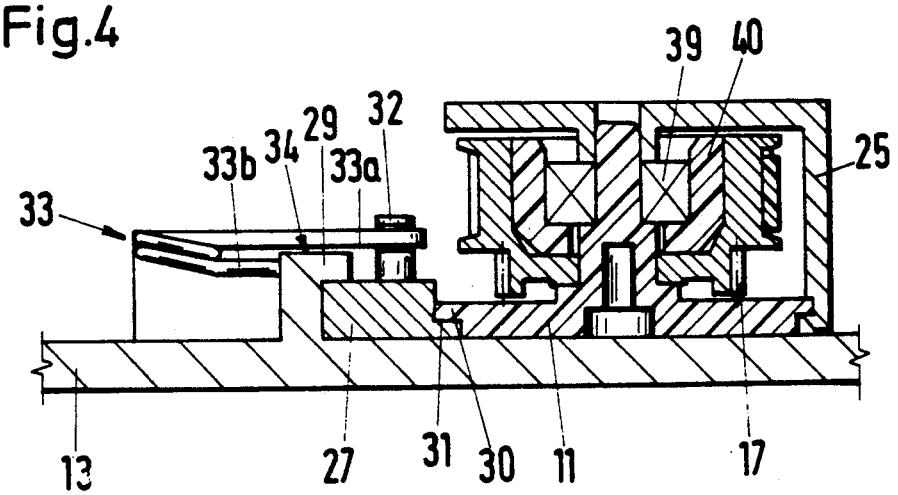
FIG. 4 is a vertical cross-section taken along the lines E–F in FIG. 1.

The lower and upper housing parts 11, 12, which together form the carrier housing 8, are coupled and held together by clamping arms 25 (FIGS. 2 and 4). One or both of the lower and upper housing parts also carry spacers 26 (FIG. 3) which are injection molded to the housing part(s) and which are effective to maintain the desired spaced relation between the opposed walls of the housing parts and thereby assist in defining its interior space.

The tensioning device of the apparatus comprises a tensioning wedge 27 which engages captively below a projection 29 fastened to the printer frame 13 and which extends obliquely to the direction 28 of tensioning movement of the carrier housing 8 (FIG. 1). The lower part 11 of the carrier housing 8 is provided with an outwardly protruding projection 30 which rests atop a ledge-like shoulder 31 of the tensioning wedge 27, the shoulder extending substantially perpendicular to the tensioning direction 28. The tensioning wedge 27 also carries a first abutment 32 against which the first, longer leg 33*a* of a leg spring 33 presses; the second, shorter leg 33*b* of the spring 33 lies against a second abutment 34 which is defined on the printer frame 13. The leg spring 33 accordingly normally urges the tensioning wedge 27 upwardly (in FIG. 1) whereby the belt or pull means 4 is maintained in a tensioned or stretched condition.

Figure 5:
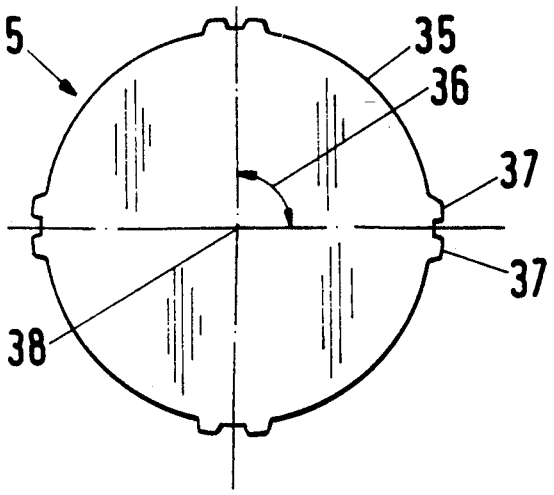
FIG. 5 is plan view of the reversal roller, showing its peripheral contour.

Referring now to FIG. 5, the reversal roller 5 is provided on its circumferential face or surface 35, about which the drive belt 4 is partially wrapped, with at least one tooth-like radially-outwardly projecting bead 37 located in each quarter 36 of its circumference. Two such beads 37, disposed in closely spaced relation in each pair of immediately-adjacent circumferential quarters 36, are shown by way of example in the drawing. The beads 37 extend substantially parallel to the extension of the rotative axis 38 of the reversal roller 5. The roller 5 is further mounted in the carrier housing 8 by means of an anti-friction bearing 39 (FIG. 4) which is embedded in a vibration-damping elastic bearing shell 40 inserted concentrically within the reversal roller 5.

Figure 6:
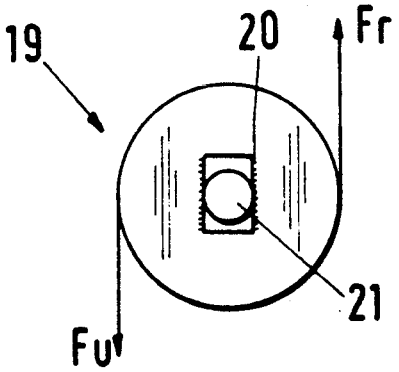
FIG. 6 depicts the forces acting on the intermediate gearwheel.

In operation, and referring to FIG. 6, when the reversal roller 5 rotates in the direction 7*b*, by virtue of the spring 22 a circumferential force Fu is produced by the frictional force Fr generated between the spring 22 and the circumference 24 of the intermediate gearwheel 19. As a consequence, the intermediate gearwheel 19 is urged (FIG. 1) in the direction of movement 23*b* and into second gearwheel The clockwise (in FIG. 1) rotation of the reversal roller 5 is accordingly transferred to and rotates the intermediate gearwheel 19 in the counterclockwise direction, this rotation of the intermediate gearwheel in turn being transferred to and effecting a clockwise rotation of the second gearwheel 18 and the inked-ribbon drive shaft 10 to which the gearwheel 18 is secured. The inked ribbon is thereby advanced within its cassette by an amount directly related to the amount of clockwise rotation of the reversal roller 5 and the corresponding longitudinal movement 6*b* of the print-head carriage 1.

With a change in the direction of rotation of the reversal roller to the direction 7*a*, an oppositely-acting circumferential force Fu presses the intermediate gearwheel 19 in the direction 23*a* and thus out of engagement with the second gearwheel 18. Accordingly, counterclockwise (in FIG. 1) rotation of the reversal roller 5 drives the intermediate gearwheel 19 through a corresponding clockwise rotation; this clockwise rotation of the intermediate gearwheel is not, however, transferred to the second gearwheel 18 and inked-ribbon drive shaft 10. That is, longitudinal displacement of the intermediate gearwheel 19 in the direction 23*a* uncouples the gearwheel 19 from edge-to-edge engagement with the second gearwheel 18 so that the clockwise rotation of the intermediate gearwheel 19 is not transferred to the second gearwheel 18 and inked-ribbon drive shaft 10. As should now be apparent, the intermediate gearwheel 19 defines and operates in the manner of a releaseable clutch for alternately coupling and uncoupling the second gearwheel 18 and attached inked-ribbon drive shaft 10. The drive shaft 10 is accordingly rotated by the reversing roller 5, through the intermediate gearwheel 19, as a function of the direction of rotation of the reversal roller.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a printer including an inked-ribbon drive shaft (10) rotatable for advancing an inked ribbon, a drive motor (2) having a shaft and operable for rotating said shaft in forward and reverse rotative directions, a drive roller (3) connected to said shaft for operative rotation in said forward and reverse rotative directions, a reversal roller (5) mounted for rotation in spaced relation to said drive roller (3), a print-head carriage (1), elongated pull means (4) trained about said drive and reversal rollers for longitudinal movement by said rollers in first and second directions as said drive roller (3) is operatively rotated in said forward and reverse rotative directions, respectively, said pull means (4) being attached to said print-head carriage (1) for moving said print-head carriage in said first and second directions, a carrier housing (8), said carrier housing supportedly carrying said reversal roller (5), a tensioning wedge (27), clutch means (9) movable into and out of coupled relation with said inked-ribbon drive shaft (10), as a function of the direction of rotation of said reversal roller (5), for transferring said forward direction rotation of said reversal roller to a driven rotation of said inked-ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), whereby said inked-ribbon drive shaft is rotatively driven by rotation of said reversal roller in only one of said first and second rotatative directions of said reversal roller said clutch means comprising an intermediate gearwheel (19) rotatably between said reversal roller and said inked-ribbon drive shaft (10), spring means for applying a spring force to and for thereby normally urging said intermediate gearwheel into rotation-transferring relation with one of said reversal roller and said inked-ribbon drive shaft (10), said intermediate gearwheel being disposed for longitudinal movement between first and second positions providing said coupled and uncoupled relations, respectively, between said intermediate gearwheel (19) and said inked-ribbon drive shaft (10), said carrier housing (8) comprising lower (11) and upper (12) housing parts and defining rotary bearings (16) for said reversal roller (5) and said inked-ribbon drive shaft (10), a first gearwheel (17) coaxially-carried on said reversal roller (5), a second gearwheel (18) mounted on said inked-ribbon drive shaft (10) and carried on said carrier housing (8) in spaced relation to said reversal roller (5), said intermediate gearwheel (19) being rotatably mounted between said reversal roller (5) and said second gearwheel (18) and being disposed for said longitudinal movement between said first and second positions under said spring force by which said intermediate gearwheel (19) is normally urged into abutment with one of said first gearwheel (17) and said reversal roller (5), and said spring means comprising a onearmed spring (22) disposed so as to abut the circumference (24) of said intermediate gearwheel (19) under an initial tension and thereby provide said spring force normally urging said intermediate gearwheel (19) into said abutment with one of said first gearwheel (17) and said reversal roller (5).

2. In a printer in accordance with claim 1, a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8), said printer frame carrying a second abutment (34), and a leg spring (33) having a first, relatively longer arm in engagement with said first abutment and a second, relatively shorter arm in engagement with said second abutment.

3. In a printer in accordance with claim 1, said reversal roller (5) including a surface (35) for receiving said pull means in trained relation thereabout, and an outwardly-projecting tooth-like bead (37) defined on said receiving surface (35) in at least each circumferential quarter (36) of said reversal roller (5).

4. In a printer in accordance with claim 1, an oscillation-damping elastic bearing shell (40) inserted concentrically into said reversing roller (5), and an anti-friction bearing (39) embedded in said bearing shell (40) for rotatably-mounting said reversal roller (5) on said carrier housing (8).

5. In a printer in accordance with claim 1, said lower housing part (11) being formed of a plasticizable plastic and said one armed spring (22) being formed as an integral, injection molded extension of said lower housing part (11).

6. In a printer in accordance with claim 5, spacers (26) provided within said carrier housing (8) between said lower (11) and upper (12) housing parts, and spring clamp arms (25) carried on at least one of said lower and upper housing parts for interengageably coupling said upper and lower housing parts.

7. In a printer in accordance with claim 5, a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8), said printer frame carrying a second abutment (34), and a leg spring (33) having a first, relatively longer arm in engagement with said first abutment and a second, relatively shorter arm in engagement with said second abutment.

8. In a printer in accordance with claim 5, said reversal roller (5) including a surface (35) for receiving said pull means in trained relation thereabout, and an outwardly-projecting tooth-like bead (37) defined on said receiving surface (35) in at least each circumferential quarter (36) of said reversal roller (5).

9. In a printer in accordance with claim 5, an oscillation-damping elastic bearing shell (40) inserted concentrically into said reversal roller (5), and an anti-friction bearing (39) embedded in said bearing shell (40) for rotatably-mounting said reversal roller (5) on said carrier housing (8).

10. In a printer in accordance with claim 1, spacers (26) provided within said carrier housing (8) between said lower (11) and upper (12) housing parts, and spring clamp arms (25) carried on at least one of said lower and upper housing parts for interengageably coupling said upper and lower housing parts, 11. In a printer in accordance with claim 10, an oscillation-damping elastic bearing shell (40) inserted concentrically into said reversal roller (5), and an anti-friction bearing (39) embedded in said bearing shell (40) for rotatably-mounting said reversal roller (5) on said carrier housing (8).

12. In a printer including an inked-ribbon drive shaft (10) rotatable for advancing an inked ribbon, a drive motor (2) having a shaft and operable for rotating said shaft in forward and reverse rotative directions, a drive roller (3) connected to said shaft for operative rotation in said forward and reverse rotative directions, a reversal roller (5) mounted for rotation in spaced relation to said drive roller (3), a print-head carriage (1), elongated pull means (4) trained about said drive and reversal rollers for longitudinal movement by said rollers in first and second directions as said drive roller (3) is operatively rotated in said forward and reverse directions, respectively, said pull means (4) being attached to said print-head carriage (1) for moving said print-head carriage in said first and second directions, a carrier housing (8), said carrier housing supportedly carrying said reversal roller (5), a tensioning wedge (27), clutch means (9) movable into and out of coupled relation with said inked-ribbon drive shaft (10), as a function of the direction of rotation of said reversal roller (5), for transferring said forward direction rotation of said reversal roller to a driven rotation of said inked-ribbon drive shaft (10) through intermediately coupled relation of said clutch means (9) and for non-transfer of said reverse direction rotation of said reversal roller (5) to said inkedribbon drive shaft (10) through said upcoupled relation of said clutch means (9), whereby said inked-ribbon drive shaft is rotatively driven by rotation of said reversal roller in only one of said first and second rotative directions of said reversal roller said clutch means comprising an intermediate gearwheel (19) rotatably mounted between said reversal roller and said inked-ribbon drive shaft (10), spring means for applying a spring force to and for thereby normally urging said intermediate gearwheel into rotation-transferring relation with one of said reversal roller and said inked-ribbon drive shaft (10), said intermediate gearwheel being disposed for longitudinal movement between first and second positions providing said coupled and uncoupled relations, respectively, between said intermediate gearwheel (19) and said inked-ribbon drive shaft (10), a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8), said printer frame carrying a second abutment (34), and a leg spring (33) having a first, relatively longer arm in engagement with said first abutment and a second, relatively shorter arm in engagement with said second abutment.

13. In a printer including an inked-ribbon drive shaft (10) rotatable for advancing an inked ribbon, a drive motor (2) having a shaft and operable for rotating said shaft in forward and reverse rotative directions, a drive roller (3) connected to said shaft for operative rotation in said forward and reverse rotating directions, a reversal roller (5) mounted for rotation in spaced relation to said drive roller (3), a print-head carriage (1), elongated pull means (4) trained about said drive and reversal rollers for longitudinal movement by said roller in first and second directions as said drive roller (3) is operatively rotated in said forward and reverse rotative directions, respectively, said pull means (4) being attached to said print-head carriage (1) for moving said print-head carriage in said first and second directions, a carrier housing (8), said carrier housing supportedly carrying said reversal roller (5), a tensioning wedge (27), clutch means (9) movable into and out of coupled relation with said inked-ribbon drive shaft (10), as a function of the direction of rotation of said reversal roller (5), for transferring said forward direction rotation of said reversal roller to a driven rotation of said inked-ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), whereby said inked-ribbon drive shaft is rotatively driven by rotation of said reversal roller in only one of said first and second rotative directions of said reversal roller said clutch means comprising an intermediate gearwheel (19) rotatably mounted between said reversal roller and said inked-ribbon drive shaft (10), spring means for applying a spring force to and for thereby normally urging said intermediate gearwheel into rotation-transferring relation with one of said reversal roller and said inked-ribbon drive shaft (10), said intermediate gearwheel being disposed for longitudinal movement between first and second positions providing said coupled and uncoupled relations, respectively, between said intermediate gearwheel (19) and said inked-ribbon drive shaft (10), said carrier housing (8) comprising lower (11) and upper (12) housing parts and defining rotary bearings (16) for said reversal roller (5) and said inked-ribbon drive shaft (10), a first gearwheel (17) coaxially-carried on said reversal roller (5)

a second gearwheel (18) mounted on said inked-ribbon drive shaft (10) and carried on said carrier housing (8) in spaced relation to said reversal roller (5), said intermediate gearwheel (19) being rotatably mounted between said reversal roller (5) and said second gearwheel (18) and being disposed for said longitudinal movement between said first and second positions under said spring force by which said intermediate gearwheel (19) is normally urged into abutment with one of said first gearwheel (17) and said reversal roller (5).

a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8);

said printer frame carrying a second abutment (34), and a leg spring (33) having a first, relatively longer arm in engagement with said first abutment and a second, relatively shorter arm in engagement with said second abutment.

14. In a printer including an inked-ribbon drive shaft (10) rotatable for advancing an inked ribbon, a drive motor (2) having a shaft and operable for rotating said shaft in forward and reverse rotative directions, a drive roller (3) connected to said shaft for operative rotation in said forward sand reverse rotative directions, a reversal roller (5) mounted for rotation in spaced relation to said drive roller (3), a print-head carriage (1), elongated pull means (4) trained about said drive and reversal rollers for longitudinal movement by said rollers in first and second directions as said drive roller (3) is operatively rotated in said forward and reverse directions, respectively, said pull means (4) being attached to said print-head carriage (1) for moving said print-head carriage in said first and second directions, a carrier housing (8), said carrier housing supportedly carrying said reversal roller (5), a tensioning wedge (27), clutch means (9) movable into and out of coupled relation with said inked-ribbon drive shaft (10), as a function of the direction of rotation of said reversal roller (5), for transferring said forward direction rotation of said reversal roller to a driven rotation of said inked-ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), whereby said inked-ribbon drive shaft is rotatively driven by rotation of said reversal roller in only one of said first and second rotative directions of said reversal roller said clutch mean comprising an intermediate gearwheel (19) rotatably mounted between said reversal roller and said inked-ribbon drive shaft (10), spring means for applying a spring force to and for thereby normally urging said intermediate gearwheel into rotation-transferring relation with one of said reversal roller and said inked-ribbon drive shaft (10), said intermediate gearwheel being disposed for longitudinal movement between first and second positions providing said coupled and uncoupled relations, respectively, between said intermediate gearwheel (19) and said inked-ribbon drive shaft (10), said carrier housing (8) comprising interengageable lower (11) and upper (12) housing parts, spacers (26) provided within said carrier housing (8) between said lower (11) and upper (12) housing parts, spring clamp arms (25) carried on at least one of said lower and upper housing parts for interengageably coupling said upper and lower housing parts, a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8), said printer frame carrying a second abutment (34), and a leg spring (33) having a first, relatively longer arm in engagement with said first abutment and a second, relatively shorter arm in engagement with said second abutment.

15. In a printer including a inked-ribbon drive shaft (10) rotatable for advancing an inked ribbon, a drive motor (2) having a shaft and operable for rotating said shaft in forward and reverse rotation directions, a drive roller (3) connected to said shaft for operative rotation in said forward and reverse rotative directions, a reversal roller (5) mounted for rotation in spaced relation to said drive roller (3);

a print-head carriage (1), elongated pull means (4) trained about said drive and reversal rollers for longitudinal movement by said rollers in first and second directions as said drive roller (3) is operatively rotated in said forward and reverse rotative directions, respectively, said pull means (4) being attached to said print-head carriage (1) for moving said print-head carriage in said first and second directions, a carrier housing (8), said carrier housing supportedly carrying said reversal roller (5), said carrier housing (8) comprising lower (11) and upper (12) housing parts and defining rotary bearings (16) for said reversal roller (5) and said inked-ribbon drive shaft (10), a tensioning wedge (27), clutch means movable into and out of coupled relation with said inked-ribbon drive shaft (10), as a function of the direction of said reversal roller (5), for transferring said forward direction rotation of said reversal roller to a driven rotation of said inked ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), wherein said inked-ribbon drive shaft is rotatively driven by rotation of said reversal roller in only one of said first and second rotative directions of said reversal roller, a first gearwheel (17) coaxially-carried on said reversal roller (5), a second gearwheel (18) mounted on said inked-ribbon drive shaft (10) and carried on said carrier housing (8) in spaced relation to said reversal roller (5), said clutch means comprising an intermediate gearwheel (19) rotatably mounted between said reversal roller (5) and said second gearwheel (18), said intermediate gearwheel being dispeod for longitudinal movement between first and second positions under a spring force normally urging said intermediate gearwheel (19) into abutment with one of said first gearwheel (17) and said reversal roller (5), said longitudinal movement between said first and second positions providing said coupled and uncoupled relations, respectively, between said intermediate gearwheel (19) and said inked-ribbon drive shaft (10), and a one-armed spring (22) disposed so as to abut the circumference (24) of said intermediate gearwheel (19) under an initial tension and thereby provide said spring force normally urging said intermediate gearwheel (19) into said abutment with one of said first gearwheel 917) and said reversal roller (5), said lower housing part (11) being formed of a plasticizable plastic and said one armed spring (22) being formed as an integral, injection molded extension of said lower housing part (11).

16. In a printer in accordance with claim 15, spacers (26) providing within said carrier housing (8) between said lower (11) and upper (12) housing parts, and spring clamp arms (25) carried on at least one of said lower and upper housing parts for interengageably coupling said upper and lower housing parts.

17. In a printer in accordance with claim 15, a printer frame (13), said carrier housing (8) including a protruding first projection (30), said tensioning wedge (27) including a first abutment (32) and a shoulder (31) extending substantially perpendicular to a direction (28) of tensioning movement of said carrier housing (8), said printer frame carrying a second abutment (34), and a leg spring (33) having a first, relatively longer arm in engagement with said first abutment and a second, relatively shorter arm in engagement with said second abutment.

18. In a printer in accordance with claim 15, said reversal roller (5) including a surface (35) for receiving said pull means in trained relation thereabout, and an outwardly-projecting tooth-like bead (37) defined on said receiving surface (35) in at least each circumferential quarter (36) of said reversal roller (5).

19. In a printer in accordance with claim 15, an oscillation-damping elastic bearing shell (40) inserted concentrically into said reversal roller (5), and an anti-friction bearing (39) embedded in said bearing shell (40) for rotatably-mounting said reversal roller (5) on said carrier housing (8).

20. In a printer including an inked-ribbon drive shaft (10) rotatable for advancing an inked ribbon, a printer frame (13), a drive motor (2) having a shaft and operable for rotating said shaft in forward and reverse rotative directions, a drive roller (3) connected to said shaft for operative rotation in said forward and reverse rotative directions, a reversal roller (5) mounted for rotation in spaced relation to said drive roller (3), a print-head carriage (1), elongated pull means (4) trained about said drive and reversal rollers for longitudinal movement by said rollers in first and second directions as said drive roller (3) is operatively rotated in said forward and reverse rotative directions, respectively, said pull means (4) being attached to said print-head carriage (1) for moving said print-head carriage in said first sand second directions, a carrier housing (8), said carrier housing supportedly carrying said reversal roller (5) and including a protruding first projection, a tensioning wedge (27), said tensioning wedge including a first abutment (32) and a shoulder (31) extending substantially perpendicular to a direction (28) of tensioning movement of said carrier housing (8), said printer frame (13) carrying a second abutment (34), a leg spring (33) having a first, relatively longer arm in engagement with said first abutment and a second, relatively shorter arm in engagement with said second abutment, and clutch means movable into and out of coupled relation with said inked-ribbon drive shaft (10), as a function of the direction of rotation of said reversal roller (5), for transferring said forward direction rotation of said reversal roller to a driven rotation of said inked ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), whereby said inked-ribon drive shaft is rotatively driven by rotation of said reversal roller in only one of said first and second rotative directions of said reversal roller.

21. In a printer including an inked-ribbon drive shaft (10) rotatable for advancing an inked ribbon, a printer frame (13), a drive motor (2) having a shaft and operable for rotating said shaft in forward and reverse rotative directions, a drive roller (3) connected to said shaft for operative rotation in said forward and reverse rotative directions, a reversal roller (5) mounted for rotation in spaced relation to said drive roller (3), a print-head carriage (1), elongated pull means (4) trained about said drive and reversal rollers for longitudinal movement by said rollers in first and second directions as said drive roller (3) is operatively rotated in said forward and reverse rotative directions, respectively, said pull means (4) being attached to said print-head carriage (1) for moving said print-head carriage in said first and second directions, a carrier housing (8) supportedly carrying said reversal roller (5), said carrier housing comprising interengageable lower (11) and upper (12) housing parts and including a protruding first projection (30), spacers (26) providing within said carrier housing (8) between said lower (11) and upper (12) housing parts, spring clamp arms (25) carried on at least one of said lower and upper housing parts for interengageably coupling said upper and lower housing parts, a tensioning wedge (27) including a first abutment (32) and a shoulder (31) extending substantially perpendicular to a direction (28) of tensioning movement of said carrier housing (8), said printer frame (13) carrying a second abutment (34), a leg spring (33) having a first, relatively longer arm in engagement with said first abutment and a second, relatively shorter arm in engagement with said second abutment, and clutch means movable into and out of coupled relation with said inked-ribbon drive shaft (10), as a function of the direction of rotation of said reversal roller (5), for transferring said forward direction rotation of said reversal roller to a driven rotation of said inked ribbon drive shaft (10) through intermediately coupled relation of said clutch means (9), and for non-transfer of said reverse direction rotation of said reversal roller (5) to said inkedribbon drive shaft (10) through said uncoupled relation of said clutch means (9), whereby said inked-ribbon drive shaft is rotatively driven by rotation of said reversal roller in only one of said first and second rotative directions of said reversal roller.

* * * * *